United States Patent [19]

Westerman

[11] 4,313,120

[45] Jan. 26, 1982

[54] NON-DISSIPATIVE LOAD TERMINATION FOR TRAVELLING WAVE ARRAY ANTENNA

[75] Inventor: Charles W. Westerman, El Toro, Calif.

[73] Assignee: Ford Aerospace & Communications Corp., Dearborn, Mich.

[21] Appl. No.: 184,598

[22] Filed: Sep. 5, 1980

Related U.S. Application Data

[63] Continuation of Ser. No. 62,087, Jul. 30, 1979, abandoned.

[51] Int. Cl.[3] ..... H01Q 13/10

[52] U.S. Cl. ..... 343/771; 343/770

[58] Field of Search ..... 343/767-771, 343/854

[56] References Cited

U.S. PATENT DOCUMENTS

| | | | |
|---|---|---|---|
| 2,894,261 | 7/1959 | Yaru | 343/771 |
| 2,994,874 | 8/1961 | Kihn et al. | 343/768 |
| 3,176,300 | 3/1965 | Kuecken | 343/767 |
| 3,328,800 | 6/1967 | Algeo | 343/768 |
| 3,364,489 | 1/1968 | Masters | 343/731 |
| 3,530,479 | 9/1970 | Waldron | 343/771 |
| 3,978,485 | 8/1976 | Bonnaval | 343/767 |
| 4,047,179 | 9/1977 | Appelbaum et al. | 343/768 |
| 4,170,778 | 10/1979 | Bowman | 343/771 |

*Primary Examiner*—David K. Moore

*Attorney, Agent, or Firm*—Peter Abolins; Clifford L. Sadler

[57] ABSTRACT

This specification discloses a nondissipative load termination for a traveling wave antenna array whereby energy incident at the end of the antenna array is applied directly to the main beam of the array with the same polarization as the main beam so that the gain of the antenna is improved.

3 Claims, 4 Drawing Figures

FIG. 1
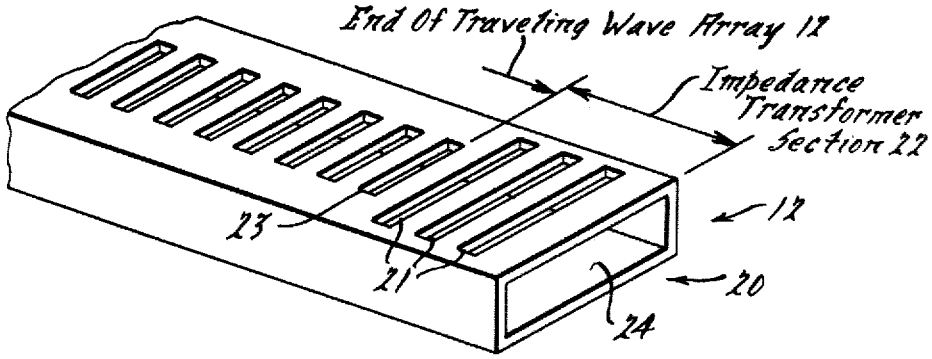
FIG. 2
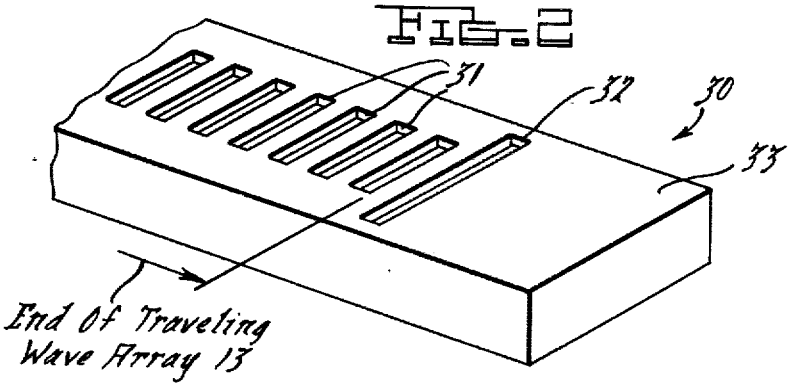
FIG. 3
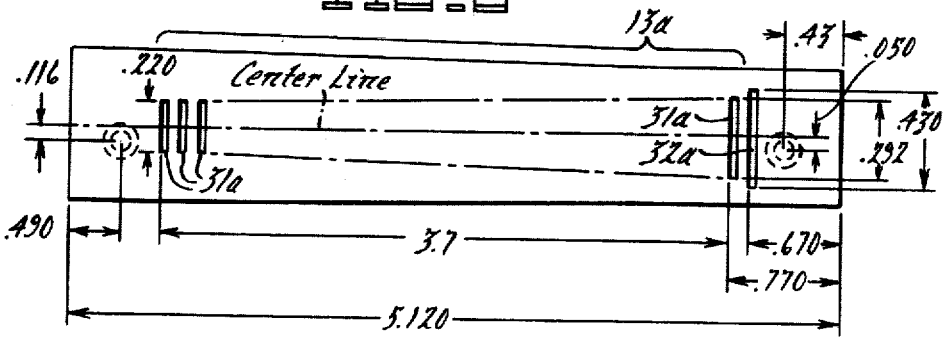
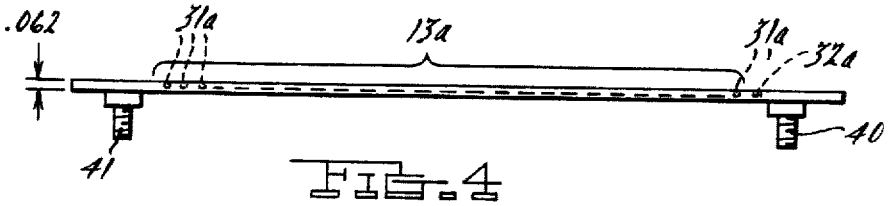
FIG. 4

NON-DISSIPATIVE LOAD TERMINATION FOR TRAVELLING WAVE ARRAY ANTENNA

This is a continuation of application Ser. No. 062,087, filed July 30, 1979, and now abandoned.

BACKGROUND OF THE INVENTION (1) Field of the Invention

This invention relates to antennas and, more particularly, to traveling wave antennas.

(2) Prior Art

The load termination for a traveling wavy array should absorb or radiate without reflecting all the energy incident upon the end of the array to avoid a large back lobe. Known prior art traveling wave arrays have utilized two kinds of load terminations: resistive and radiating. An internal nonradiating resistive termination absorbs all of the energy, typically about 10% of the total energy incident upon the end of the array, so that no reflected back lobe in the antenna pattern occurs. When a resistive termination is used, the efficiency of the array cannot exceed 90% because of the energy lost in the resistive load. Further, resistors for such terminations typically dissipate several to tens of watts or more power, and they require considerable space and care in mounting for thermal control.

On the other hand, prior art radiating load terminations dissipate all energy incident upon the end of the array in a direction or polarization other than the principal polarization and direction of the main beam of the array. Thus, prior art radiating load terminations do not contribute to the gain and efficiency of the traveling wave array. Radiating loads have been used on the back sides of traveling wave arrays. The radiation takes place on the inside of the cylinder into which the array is mounted and is wasted. These are some of the problems this invention overcomes.

SUMMARY OF THE INVENTION

This invention teaches a radiating load termination which applies energy incident at the end of a traveling wave array directly into the main beam of the array with the same polarization as the main beam so that the gain of the antenna is improved. The nondissipative radiating load permits the efficiency to approach 100% by radiating rather than absorbing the energy incident upon the end of the array. An apparatus in accordance with an embodiment of this invention does not interfere with typical design procedures used for minimizing the side lobe level of the traveling wave array. This radiating load also increases efficiency, reduces manufacturing cost, reduces construction complexity and weight, and contributes to the gain of the array.

A particularly advantageous use is for terminating traveling wave array antennas mounted in groups on small cylinders to form tracking or search beams on an active radar guided missile application. The elimination of the resistive load termination results in a compact design which permits packaging several antennas onto a small missile and avoids the cost of hand labor and materials associated with the resistive load termination.

In accordance with an embodiment of this invention, an antenna includes an apertured wave guide having a nondissipative load termination means for radiating energy in a direction substantially parallel to the wave guide. In a first embodiment, the nondissipative load termination means includes an open end wave guide radiating load adjacent to a slot means for impedance transforming a section of the wave guide adjacent nonresonant slots of the traveling wave array.

BRIEF DESCRIPTION OF THE DRAWINGS

FIG. 1 is a perspective view of an end portion of a traveling wave array antenna configured in accordance with a first embodiment of this invention having an open end waveguide radiating load;

FIG. 2 is a perspective view of an end portion of a traveling wave antenna array in accordance with a second embodiment of this invention having a broad wall slot with radiating load adjacent a closed end of a traveling waveguide antenna;

FIG. 3 is a top plan view of the embodiment of FIG. 2; and

FIG. 4 is a side elevation view of the embodiment of FIG. 2 including a coaxial tuning stub in accordance with an embodiment of this invention.

DETAILED DESCRIPTION OF THE INVENTION

FIGS. 1 and 2 each show one type of nondissipative radiating load and impedance transformer sections used with a dielectric filled waveguide traveling wave array of transverse nonresonant slots in the broadwall of the waveguide. The configuration shown in FIG. 1 is particularly useful for long traveling wave arrays, for example those having a length greater than ten times the wavelength of the signal being radiated. The configuration shown in FIG. 2 is particularly useful for short traveling wave arrays, for example those having a length less than five times the wavelength.

Referring first to FIG. 1, a traveling wave array 12 is terminated in an open end waveguide radiating load 20 preceded by three slots 21 which serve as an impedance transforming section 22 between radiating load 20 and the final nonresonant slots 23 of traveling wave array 12. Slots 21 and 23 are closely spaced at about 0.1 wavelength or less. Slots 21 alter the characteristic impedence and velocity of propagation of transforming section 22 and are longer than the slots 23 in the traveling wave array 12. Slots 21 span approximately a quarter guide wavelength. The altered waveguide characteristic impedance in impedance transformer section 22 is somewhat higher than that of the array 12 due to the shorter array slots 23 and less than the impedance of the open end waveguide radiating load 20 at the end of traveling wave array 12. Thus, the waveguide section with the longer slots 21 (impedance transformer section 22) serves as a quarter wave transformer between the traveling wave array 12 and the radiating load 20.

To minimize the array backlobe of traveling wave array 12, relative to an unterminated array, the transformed impedance of the radiating load should not exactly match the characteristic impedance of traveling wave array 12. The transformed impedance should provide a small negative reflection coefficient which will give rise to a small reflection lobe to cancel the backlobe of the radiating load. The need for an imperfect impedance match becomes greater as the array directivity decreases.

In a second type of radiating load shown in FIG. 2, a single broad wall slot 32 terminates a traveling wave array 13 and is followed by a shorted waveguide impedance matching section 33. Such an arrangement is particularly suited to low directivity arrays which require an imperfect impedance match with a negative reflection coefficient (i.e., one wherein the phase is reversed) to minimize the array backlobe. The length of radiating load slot 32 and shorted waveguide length both can be adjusted to yield a wide range of negative reflection coefficient values to minimize the backlobe of traveling wave array 13 for a wide range of array directivity values. In an electrical equivalent model the reactance of the shorted waveguide section would be in series with the impedance of the radiating load slot.

The traveling wave array 12 shown in FIG. 1 has been applied to end fire traveling wave array consisting of closely spaced, nonresonant tranverse slots in a dielectric loaded waveguide. The measured gain of the array operating at X-band was 15.5 dB with the radiating load and 15.2 dB when a resistive load termination was used. The 0.3 dB gain improvement represents a 0.6 dB improvement in system performance in two way active radar applications. The measured back lobe of the array relative to peak gain was −20 dB with the radiating load and −30 dB with a resistive load termination. The array was approximately 16 inches long by ½ inch wide by 1/16 inch thick and was fabricated according to known printed circuit techniques. The absence of a resistive load termination permitted the installation of eight antennas of a 3½ inch diameter cylinder without drilling holes into the structure at the load end of each antenna.

The traveling wave array 13 shown in FIG. 2 has been applied to a near end fire array (beam centered 23° from end fire) of a similar design as that referred to in the previous paragraph but having lower gain than the previously discussed end fire array. The measured gain of the near end fire array was 13 dB with the second type radiating load. The gain improvement attributable to the radiating load was determined to be 0.4 dB. The measured back lobe relative to the peak gain of the array was 15 dB.

The nondissipative radiating load described above radiates in a manner which contributes to forward gain, permits optimization of the back lobe level relative to an unterminated array and it does not interfere with the normal design procedure for minimizing the side lobe level of the traveling wave array.

Referring to FIGS. 3 and 4, a traveling wave array 13*a* includes a coaxial tuning stub 40 which is positioned about 0.43 inches from the end of array 13*a* and about 0.05 inches off the longitudinal axis of array 13*a*. The furthest edge of the radiating load slot 32*a* is about 0.67 inches from the end of array 13*a*, and the furthest edge of the closest of slots 31*a* is about 0.77 inches from end array 13*a*. The length of a slot 31*a* is about 0.292 inches, the length of slot 32*a* is about 0.43 inches. The length of slots 31*a* goes down to about 0.22 inches at the left end of array 13*a*. In contrast, the total width of array 13*a* increases from a right width of about 0.455 inches to a left width of about 0.513 inches. The left coaxial input terminal 41 is positioned about 0.116 inches off center and about 0.49 inches from the left end array 13. The thickness of array 13 is about 0.062 inches. The total length of array 13*a* is about 5.12 inches and the length containing slots 31*a* along array 13*a* is 3.7 inches.

The short circuited waveguide serves as a reactive tuning element which primarily affects only the last slot in a manner which causes this slot to radiate all of the remaining energy which was not radiated by the traveling wave array and to suppress the standing wave which would otherwise occur within the waveguide. In practice, the radiating load termination produces a small residual reflection coefficient whose magnitude is the same and whose phase is opposite to that of the back lobe. Thus, the reflection coefficient cancels the back lobe. In other words, the amount of energy which is reflected due to the reflection coefficient is equal to the normal back lobe of the traveling wave array, thus allowing the energy of the radiating load to be added to the main beam.

With respect to FIG. 1, an open end waveguide radiating load is preceded by three slots which serve as an impedance transforming section terminating the final nonresonant slots of the traveling wave array. The slots alter the characteristic impedance and velocity of propagation of the waveguide. The waveguide characteristic impedance in the transforming section will be somewhat higher than that of the shorter array slots and less than the impedance of the open end waveguide radiating load. Thus, the waveguide section with the longer slots serves as a quarter wave transformer between the traveling wave array and the radiating load. As is well known in the art, a quarter wave transformer can couple any impedance with another impedance. In FIG. 2, the radiating load consists of a single broad wall slot terminating the traveling wave array, followed by a shorted waveguide impedance matching section.

Various modifications and variations will no doubt occur to those skilled in the various arts to which this invention pertains. For example, the particular radiating loads transformer sections and traveling wave arrays may be varied from those described herein. These and all other variations which basically rely on the teachings through which this disclosure has advanced the art are properly considered within the scope of this invention.

I claim:

1. An antenna with a main beam comprising:

an apertured waveguide traveling wave array including a plurality of waveguide slots and a radiating load termination means for radiating electromagnetic energy in a direction parallel with said waveguide, said radiating load termination means being a radiating load termination for applying electromagnetic energy incident at the end of the antenna directly to the main beam of the antenna with the same polarization as the main beam so that gain of the antenna is improved, said apertured waveguide traveling wave array directly exciting said radiating load termination means so that substantially all input power into said traveling wave array is available for beam formation, and said radiating load termination being nondissipative so that substantially no electromagnetic energy is converted to heat, said radiating load termination including a quarter wave transformer having transformer slot means for impedance transforming in a section of said waveguide adjacent said waveguide slots of said traveling wave array, said waveguide slots being nonresonant and shorter in length than said transformer means.

2. An antenna as recited in claim 1 wherein said impedance transforming section includes three slots, adjacent slots being separated by the distance of 0.1 wavelengths or less.

3. An antenna with a main beam comprising:

an apertured waveguide traveling wave array including a plurality of waveguide slots and a radiating load termination means for radiating electromagnetic energy in a direction parallel with said waveguide, said radiating load termination means being a radiating load termination for applying electromagnetic energy at the end of the antenna directly to the main beam so that gain of the antenna is improved, said apertured waveguide traveling wave array directly exciting said radiating load termination means so that substantially all input power into said traveling wave array is available for beam formation and said radiating load termination being nondissipative so that substantially no electromagnetic energy is converted to heat, said radiating load termination including a broad wall slot means for terminating said traveling waveguide array, and a waveguide impedance matching section means adjacent said broad wall slot for providing a closed end to said waveguide and terminating a residual amount of energy, said nondissipative load termination means having a residual reflection coefficient so that there is reflected energy whose magnitude is the same and whose phase is opposite to that of a back lobe of the antenna thus canceling the back lobe, said broad wall slot means being longer in length than said waveguide slots.

* * * * *